US006000069A

United States Patent [19]

Sorimachi

[11] Patent Number: 6,000,069

[45] Date of Patent: Dec. 14, 1999

[54] COMPOUND TORQUE HINGE

[75] Inventor: Akira Sorimachi, Kanagawa, Japan

[73] Assignee: Katoh Electrical Machinery Co., Ltd., Kanagawa, Japan

[21] Appl. No.: 09/358,064

[22] Filed: Jul. 21, 1999

Related U.S. Application Data

[62] Division of application No. 09/009,452, Jan. 20, 1998.

[30] Foreign Application Priority Data

Jan. 24, 1997 [JP] Japan ..... 9-011433
Jan. 24, 1997 [JP] Japan ..... 9-011434

[51] Int. Cl.[6] ..... A47K 13/04; A47K 13/12

[52] U.S. Cl. ..... 4/248; 4/236; 4/241; 4/246.1

[58] Field of Search ..... 4/234, 1, 237, 4/241, 246.1, 246.2, 240, 242.1, 248; 16/306, 307, 308, 50, 303, 305

[56] References Cited

U.S. PATENT DOCUMENTS 5,768,718 6/1998 Sorimachi ..... 4/236

FOREIGN PATENT DOCUMENTS 3701720 8/1988 Germany ..... 4/248
6-121759 5/1994 Japan ..... 4/248

*Primary Examiner*—Henry J. Recla
*Assistant Examiner*—Tuan Nguyen
*Attorney, Agent, or Firm*—Notaro & Michalos P.C.

[57] ABSTRACT

A compound torque hinge comprising a first rotating shaft to be mounted on the toilet bowl is rotatably mounted in the case body; the first rotation control mechanism comprising a cam mechanism with a compression spring on one side portion housed in the case body of the first rotating shaft is provided; a second rotation control mechanism comprising a rotation damper is juxtaposed in two stages within the case body in the upper or lower section of the first rotation control mechanism; a driving power transmitting means is mounted between the second rotation control mechanism and the first rotation control mechanism; and on the rotating shaft one of mounting sections of the toilet seat or seat cover is rotatably supported on a bearing, while the other is fixed so as to rotate together with the rotating shaft.

7 Claims, 12 Drawing Sheets

COMPOUND TORQUE HINGE

CROSS REFERENCE TO RELATED APPLICATION

The present application is a divisional of application Ser. No. 09/009,452, filed Jan. 20, 1998.

BACKGROUND OF THE INVENTION

1. Field of the Invention

The present invention relates to a compound torque hinge suitable for use for opening and closing an opening-closing body especially of a Western style toilet.

2. Description of the Related Art

As an opening-closing hinge of Western style toilet seat and seat cover, there have been known such hinges as a hinge which is used in a cam mechanism with a compression spring on a rotating shaft, a hinge which uses a torsion spring acting in a direction in which a torque in a specific direction of rotation of the rotating shaft is cancelled, and a hinge using a fluid damper acting on the rotating shaft.

The prior art hinge used in the cam mechanism provided with the compression spring on the rotating shaft has the advantage that a torque produced is easily adjustable to the turning moment of the toilet seat and seat cover. Despite of this advantage, however, the hinge has such a drawback that the use of a large-sized device is needed to obtain a great torque.

Also, the hinge using only the prior art torsion spring on the rotating shaft has the advantage that even a small-sized device can produce a great torque. However, the hinge producing a linearly increasing or decreasing torque is not adjustable to the turning moment of the toilet seat and seat cover that draws a sine curve. The device, therefore, has such a drawback that it is hard to make adjustments of details with respect to the turning moment of the seat and seat cover and also to accentuate operation.

Furthermore, a hinge using only a prior art fluid damper has the drawback that it is hard to make fine adjustment or accentuation in opening and closing the toilet seat and seat cover, and particularly for example to provide a function to stop and hold the toilet seat at an intermediate angle or to apply a brake to the toilet seat from a predetermined angle of opening.

SUMMARY OF THE INVENTION

It is, therefore, an object of the present invention to provide a torque hinge which is capable of obtaining a great torque despite of its small size, and moreover making fine adjustments in relation to the turning moment of an opening-closing body such as the toilet seat and seat cover, and furthermore facilitating operation accentuation.

To accomplish the above-described object, the torque hinge of the present invention is comprised of a first rotating shaft is rotatably mounted in the case body of such a structure that the second rotation control means can be mounted; the first rotation control means comprising a cam mechanism with an elastic means on one side portion which is housed in the case body of the first rotating shaft being juxtaposed in two stages; a second rotation control means comprising a fluid damper is provided within the case body in the upper or lower section of the first rotation control means; a driving power transmission means is mounted between the second rotation control means and the first rotation control means; and on the rotating shaft one of mounting sections of the toilet seat or seat cover is rotatably supported on a bearing, while the other is fixed so as to rotate together with the rotating shaft.

In the present invention, the cam mechanism may be comprised of a stationary cam fixed on the partition wall provided within the hinge case with the rotating shaft inserted in the central part; a rotating-sliding cam which is slidable in the axial direction of the first rotating shaft while engaging with the first rotating shaft, facing the stationary cam; and an elastic means for pushing the rotating-sliding cam towards the stationary cam side.

Furthermore, in the present invention, the fluid damper may be comprised of a case body fixed within the hinge case; a second rotating shaft mounted within the case body with one end mounted within the case body; a valve mounted on the second rotating shaft; a viscous fluid filled in the case body; and a stopper piece projecting from the inner peripheral wall of the case body for checking the rotation of the valve.

Furthermore, in the present invention, the valve may be comprised of a blade section projecting from the second rotating shaft and housed within the case body; a groove provided in an axial direction from the edge of the blade section; a long hole provided towards one side in the direction of rotation of the blade section from one side of the groove; a cutout provided from one side of the groove towards the other side in the direction of rotation of the blade section from the other side of the groove; and a valve rockably inserted in the groove for opening and closing the long hole.

And in the present invention, the driving power transmitting means, when used, may be a gearing or a timing belt.

DESCRIPTION OF THE PREFERRED EMBODIMENTS

An opening-closing body such as Western style toilet seat and seat cover embodying the invention will hereinafter be described with reference to the accompanying drawings. It is to be noticed that the present invention is not limited to the embodiments and may be applied to various other types of opening-closing bodies.

Figure 1:
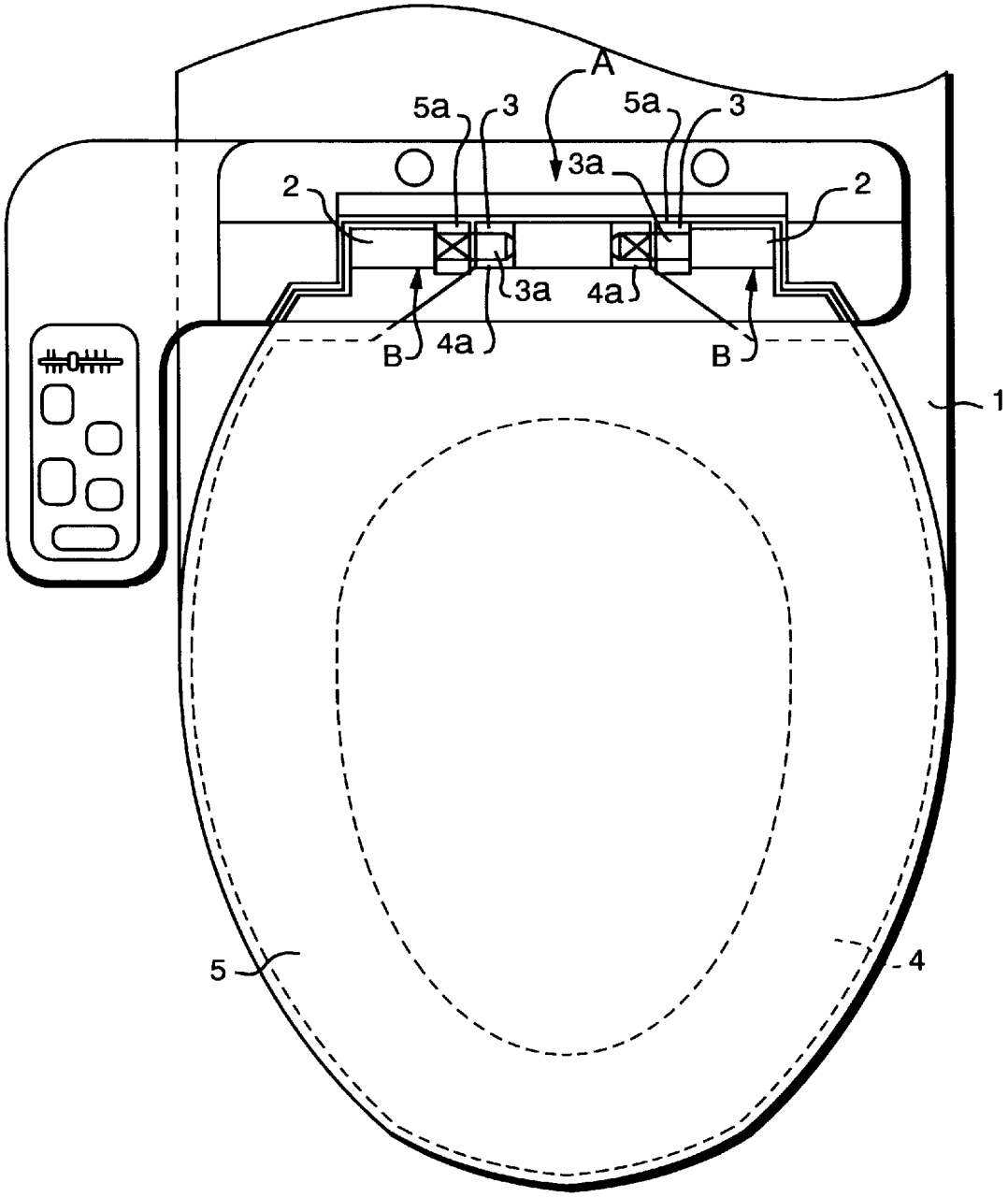
FIG. 1 is a plan view showing the opening-closing device of the Western style toilet seat and seat cover according to the present invention with the opening-closing device mounted on the toilet bowl.
Figure 2:
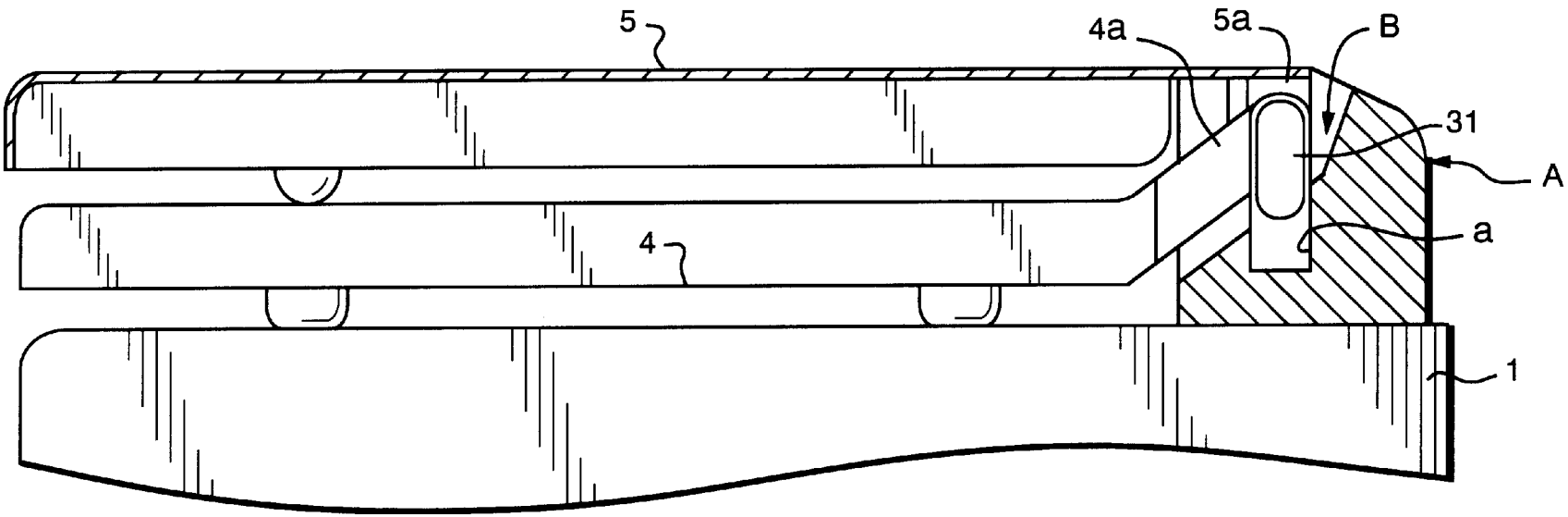
FIG. 2 is a partially sectional side view, partly unillustrated, of the opening-closing device of the Western style toilet seat and seat cover of FIG. 1 mounted on the toilet bowl.

FIGS. 1 to 12 show other embodiments of the present invention. In FIGS. 1 and 2, an operating mechanism A is mounted in the upper part of the rear end of a toilet bowl 1. In this operating mechanism A are provided mounting holes a, a vertically at predetermined spacing. In these mounting holes a, a (only one hole cais depicted) a pair of hinge cases 2, 2 are attached with their lower portion removably inserted.

From mutually opposite sides on the upper side of the hinge cases 2, 2, mounting shafts 3*a*, 3*a* of the first rotating shafts 3, 3 having an approximately elliptical section formed by cutting both sides in the axial direction protrude. On the right mounting shaft 3*a* of the first rotating shafts 3, 3, a mounting portion 4*a* on one side of a toilet seat 4 is inserted for engagement into an irregular mounting hole 4*b* having an approximately elliptical sectional form, and mounted to rotate together with the first rotating shaft 3. On the mounting shaft 3*a* of the first rotating shaft 3, one of the mounting portions 5*a* of the seat cover 5 is rotatably supported on a bearing by inserting the mounting shaft portion 3*a* into the shaft insertion hole 5*b* having a round sectional form.

Also the mounting portion 4*a* of the seat 4 is rotatably supported on a bearing by inserting the left mounting shaft portion 3*a* of the first rotating shafts 3, 3 into the shaft insertion hole of round sectional form provided therein, while the other mounting portion 5*a* of the seat cover 5 is mounted in such a manner as to rotate together with the left first rotating shaft 3 with the mounting shaft portion 3*a* inserted for engagement in the irregular mounting hole provided therein.

That is, a pair of right and left opening-closing devices of the present invention are mounted on the toilet bowl 1; the right one is for the toilet seat 4, while the left one is for the seat cover 5.

The portion inserted in the mounting holes a, a of the hinge cases 2, 2, particularly as shown in FIGS. 3 to 6, is provided with a pair of longitudinal grooves 2*a*, 2*a* in a longitudinal direction in the front and rear sides to thereby form elastic pieces 2*b*, 2*b*; and at the same time the elastic pieces 2*b*, 2*b* are provided with projections 2*c*, 2*c*, thereby absorbing a play between the lower parts of the hinge cases 2, 2 inserted in the mounting holes a, a.

FIGS. 3 to 6 show the above-described right opening-closing device B of FIG. 1. Hereinafter, therefore, only the right opening-closing device B will be explained. The left opening-closing device B is basically the same in the internal construction as the right one notwithstanding differences in weight and in operation to be performed between the seat and the seat cover, and accordingly torque selection resulting from these differences also differs, omitting the explanation related. In these figures, the portion housed within the hinge case 2 of the first rotating shaft 3 includes a large-diameter portion 3*b* at the inlet section and, consecutively to the large-diameter portion 3*b*, a small-diameter portion 3*c* of an approximately elliptical form with its both sides cut away. The large-diameter portion 3*b* is supported on a bearing in the inlet port of a first housing section 6 which is formed in and through the hinge case 2, while the small-diameter portion 3*c* is supported on a bearing in a bearing hole 6*b* formed in the partition wall 6*a* provided in the first housing section 6. Mounted in a peripheral groove 3*d* formed in the outer periphery of the large-diameter portion 3*b* is an O-ring 7.

In the first housing section 6 is housed a first rotation control means 8 of the rotating shaft 3 which is comprised of a cam mechanism fitted with an elastic means. The first rotation control means 8 is of the following constitution.

First, an engaging projection 9*a* protrusively provided on one side of the partition wall 6*a* is fitted in a plurality of engaging holes 6*c*, and a stationary cam 9 is fixed so that the cam will not rotate. On the other side of the stationary cam 9 is formed a cam portion 10 which includes a convex portion 10*a* and an concave portion 10*b* as shown particularly in FIGS. 3 and 5. Also, the small-diameter portion 3*c* is rotatably inserted in a shaft inserting bore 9*b* provided at the center.

Oppositely to the cam portion 10 of the stationary cam 9, a rotating-sliding cam 11 is rotatably and slidably mounted to rotate together with the first rotating shaft 3, with the small-diameter portion 3*c* inserted and engaged in an irregular hole 11*a* provided at the center thereof. The rotating-sliding cam 11 is provided with a convex portion 11*b* in a part facing the cam portion 10 of the stationary can 9.

Between the rotating-sliding cam 11 and the large-diameter portion 3*b* there is elastically mounted an elastic means 12 consisting of a compression spring wound around the small-diameter portion 3*c*, thereby constantly pressing the rotating-sliding cam 11 towards the stationary cam 9 side. This elastic means is usable also with a plate spring.

A first gear 14 of a later-described driving power transmitting means 13 is fastened by a mounting screw 15 on a part of the small-diameter portion 3*c* of the first rotating shaft 3 which projects out of the partition wall 6*a*.

In a bearing hole 16 provided immediately below the first rotation control means 8 of the hinge case 2, a shaft portion 17*a* of the second gear 17 of the later-described driving power transmitting means 13 is rotatably supported on a bearing. The second gear 17 is in mesh with the first gear 14.

Next, the fluid damper which is one example of the second rotation control means will be explained. As shown in FIGS. 3 to 8, there is provided a second housing section 18 below the mounting area for the first rotation control means 8 of the hinge case 2. Within this second housing section 18, the case body 19 is inserted and locked. Within this case body 19, a second rotating shaft 20 is rotatably mounted. On the second rotating shaft 20 a pair of valves 22, 22 are erectly provided in opposite positions nearly at the center. The valves 22, 22 are composed of the following members.

Figure 7:
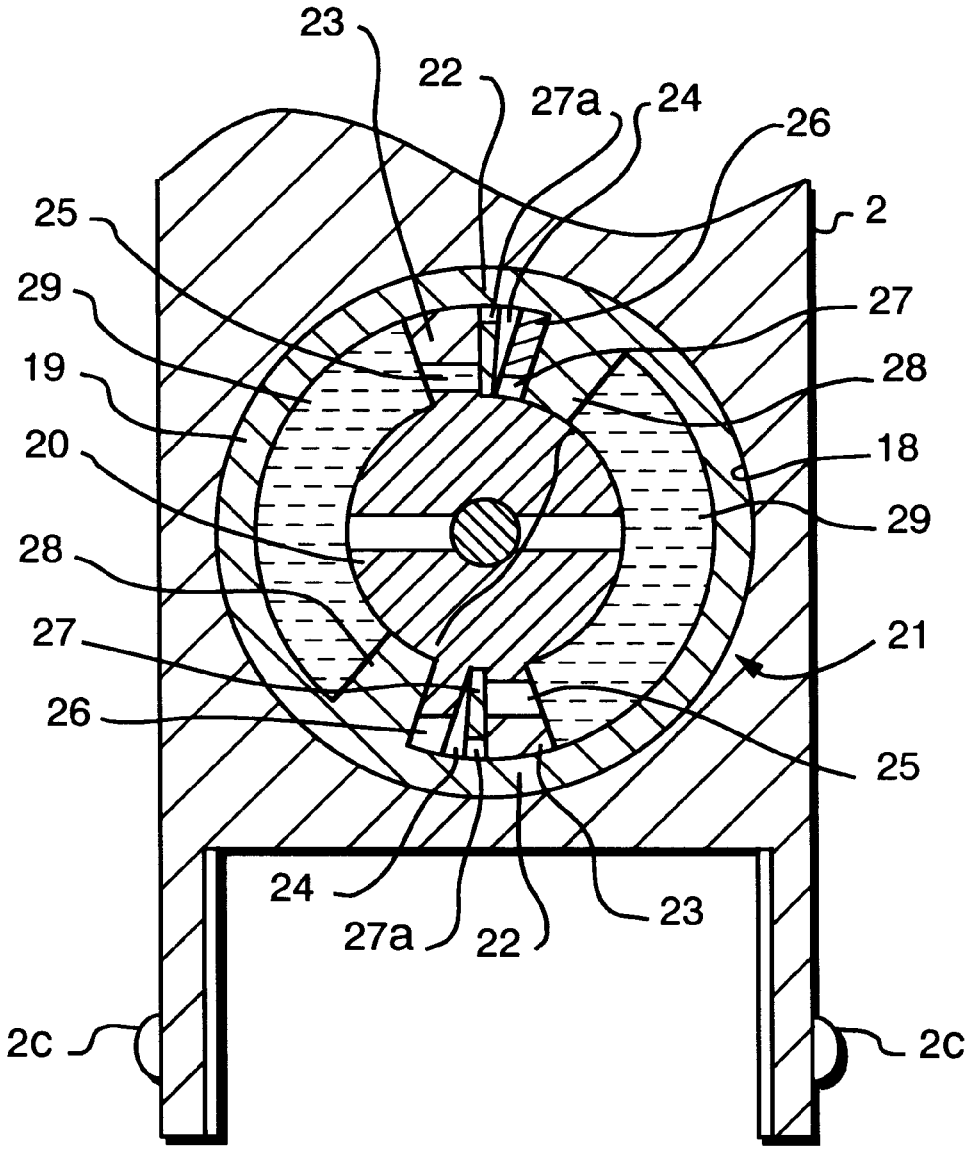
FIG. 7 is a side sectional view of the second control means of the opening-closing device of the Western style toilet seat and seat cover shown in FIG. 1.
Figure 8:
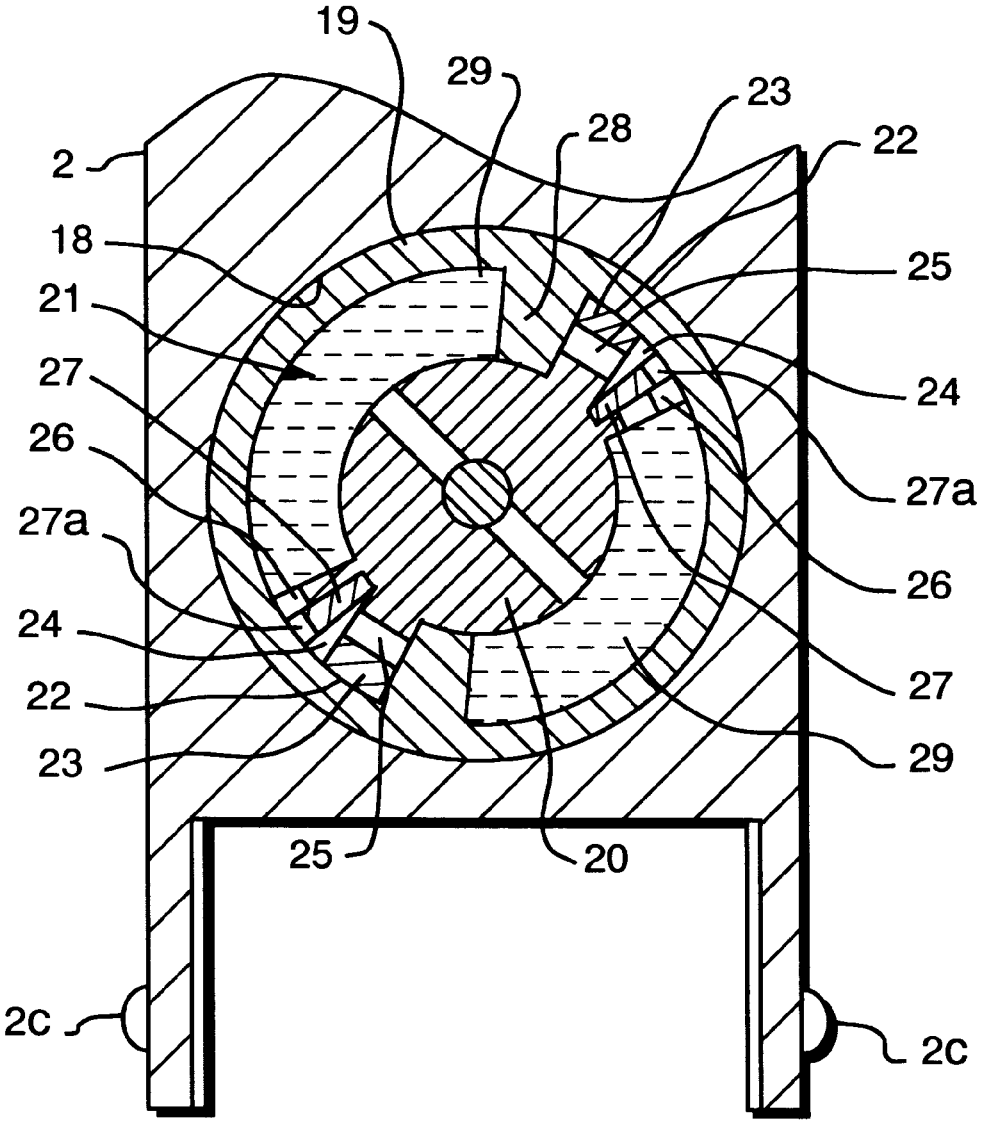
FIG. 8 is a side sectional view of the second rotation control means with the toilet seat opened to 110 degrees from the state of FIG. 6.
Figure 9:
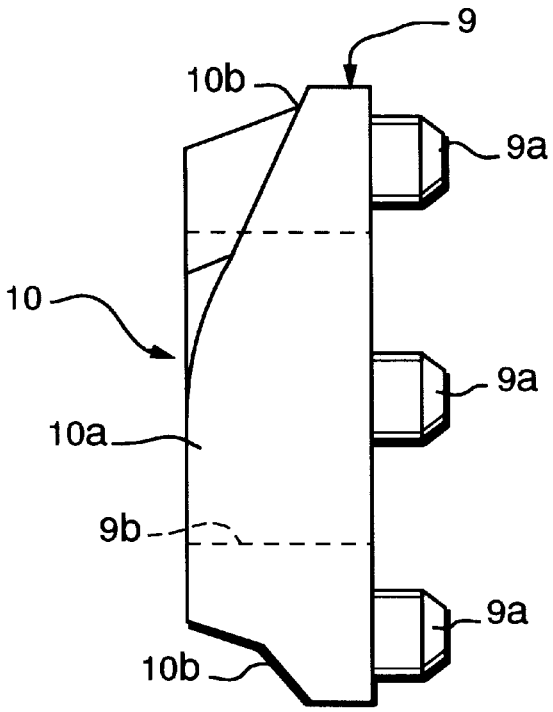
FIG. 9 is a front view of a stationary cam.
Figure 10:
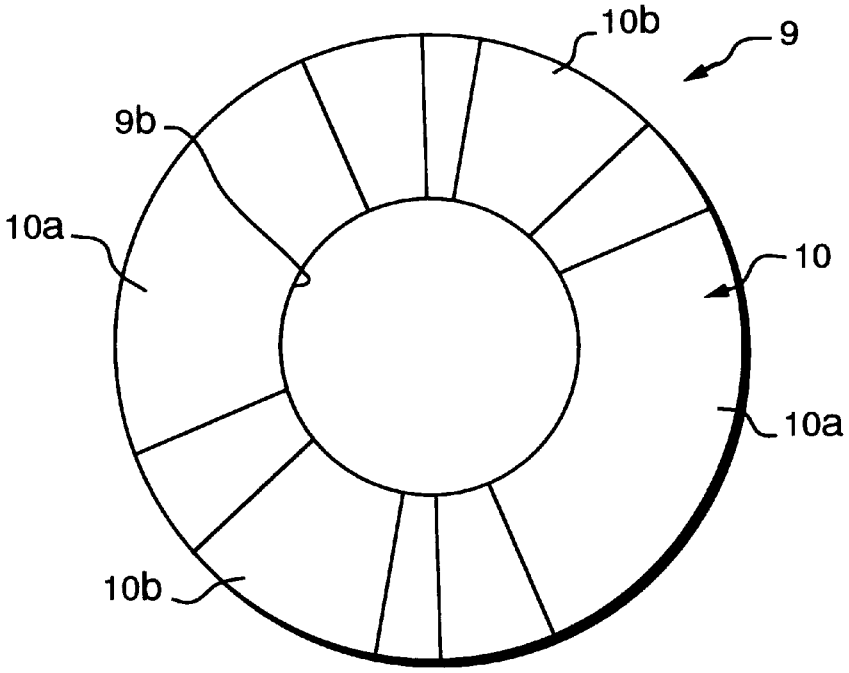
FIG. 10 is a left side view of the stationary cam.
Figure 11:
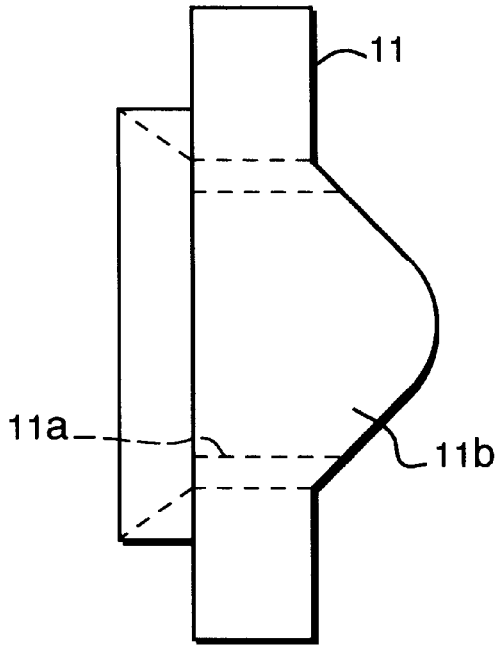
FIG. 11 is a front view of a rotating-sliding cam.
Figure 12:
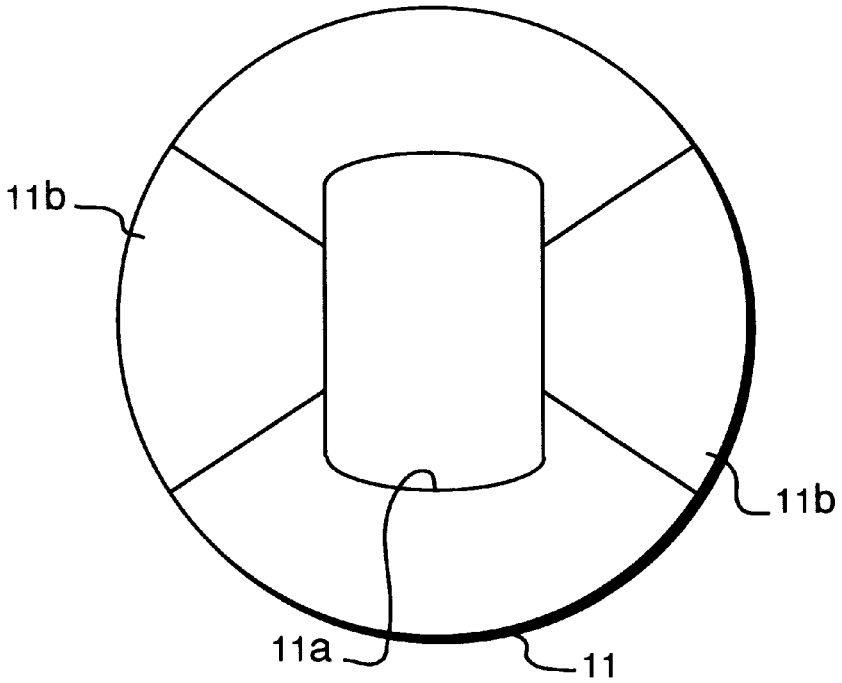
FIG. 12 is a right side view of the rotating-sliding cam shown in FIG. 11.

That is, the valves 22, 22, particularly as shown in FIGS. 7 and 8, is comprised of a pair of blade sections 23, 23 protrusively provided at a spacing of 180 degrees on the second rotating shaft 20, grooves 24 formed radially from the edge of these blade sections 23, 23, long holes 25,25 provided from one side of the grooves 24 towards one side in the direction of rotation of the blade sections 23, 23, cutouts 26, 26 formed from another side of the grooves 24 towards the other side in the direction of rotation of the blade sections 23, 23, and valves 22, 22 provided with the recesses 27*a*, 27*a* on the rocking end side rotatably set within the grooves 24.

On the inner peripheral wall of the case body 19 a pair of stopper pieces 28, 28 are protrusively provided in a radial direction. The stopper pieces 28, 28 contact the surface of the second rotating shaft 20, to thereby separate the interior of the case body 19 into two zones. The case body 19 is filled with the viscous fluid 29 such as silicone oil. On a part of the second rotating shaft 20 protruding through the side wall of the case body 19 a third rotating gear 30 is mounted in mesh with the second rotating gear 17.

The driving power transmitting means 13 is thus comprised of the first gear 14, the second gear 17, and the third gear 30.

Figure 6:
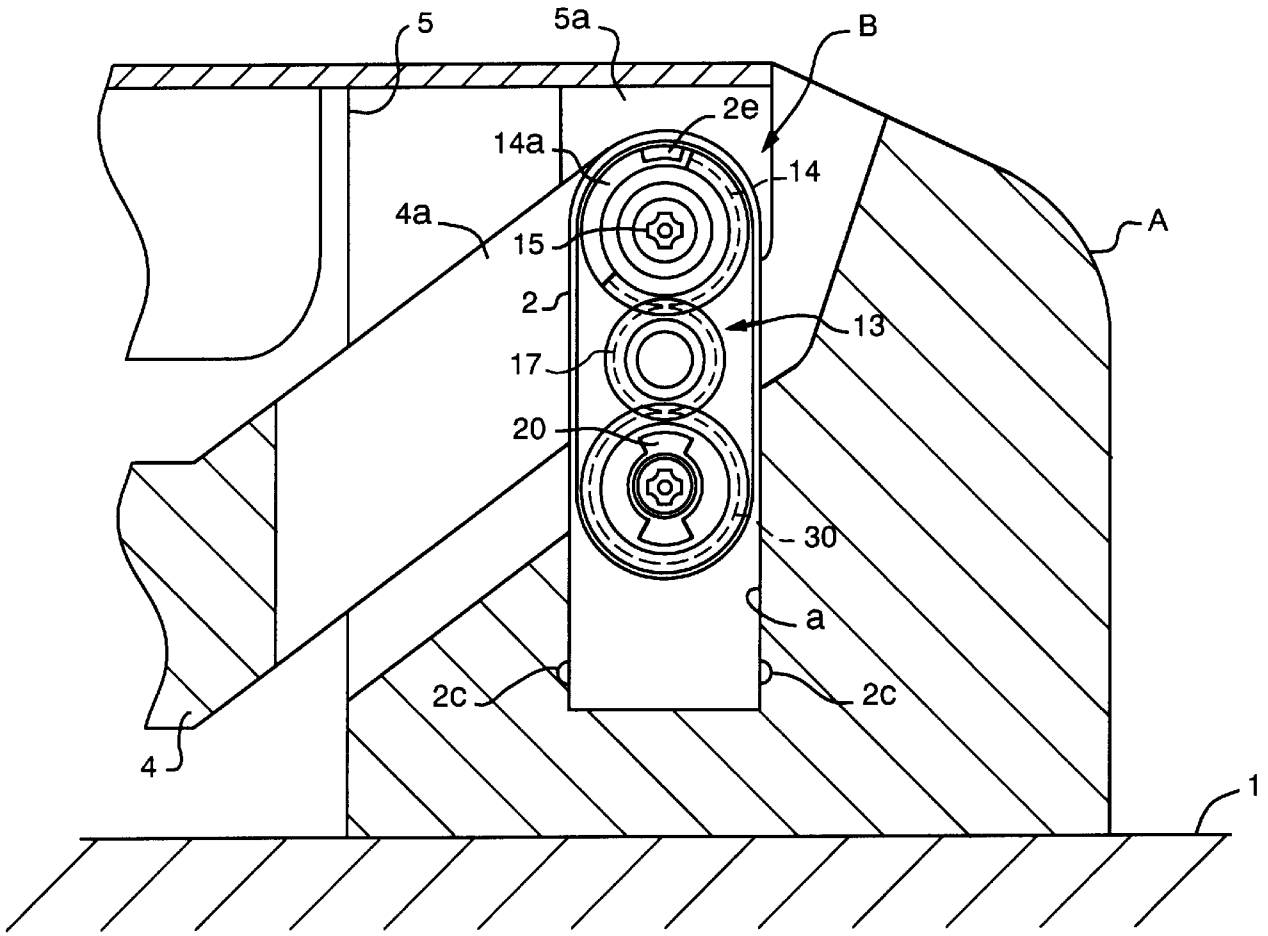
FIG. 6 is a side view showing the driving power transmission means of the opening-closing device of the Western style toilet seat and seat cover shown in FIG. 1.

The first gear 14 of the driving power transmitting means 13 is provided with a toothless portion as shown in FIG. 6. The toothless portion of the first gear 14 is provided with a half-periphery groove 14*a*, and also in this half-periphery groove 14*a*, a stopper 2*e* protruding from the hinge case 2 fits to restrict the angle of rotation of the first gear 14 within a specific range. The part of the case 2 in which the driving power transmitting means 13 is housed is fitted with a case cover 31 as shown particularly in FIGS. 3 and 4, thereby preventing entry of dust and moisture from outside. The driving power transmitting means 13 described above is comprised only of gears, which, however, may be replaced with a timing belt.

Figure 3:
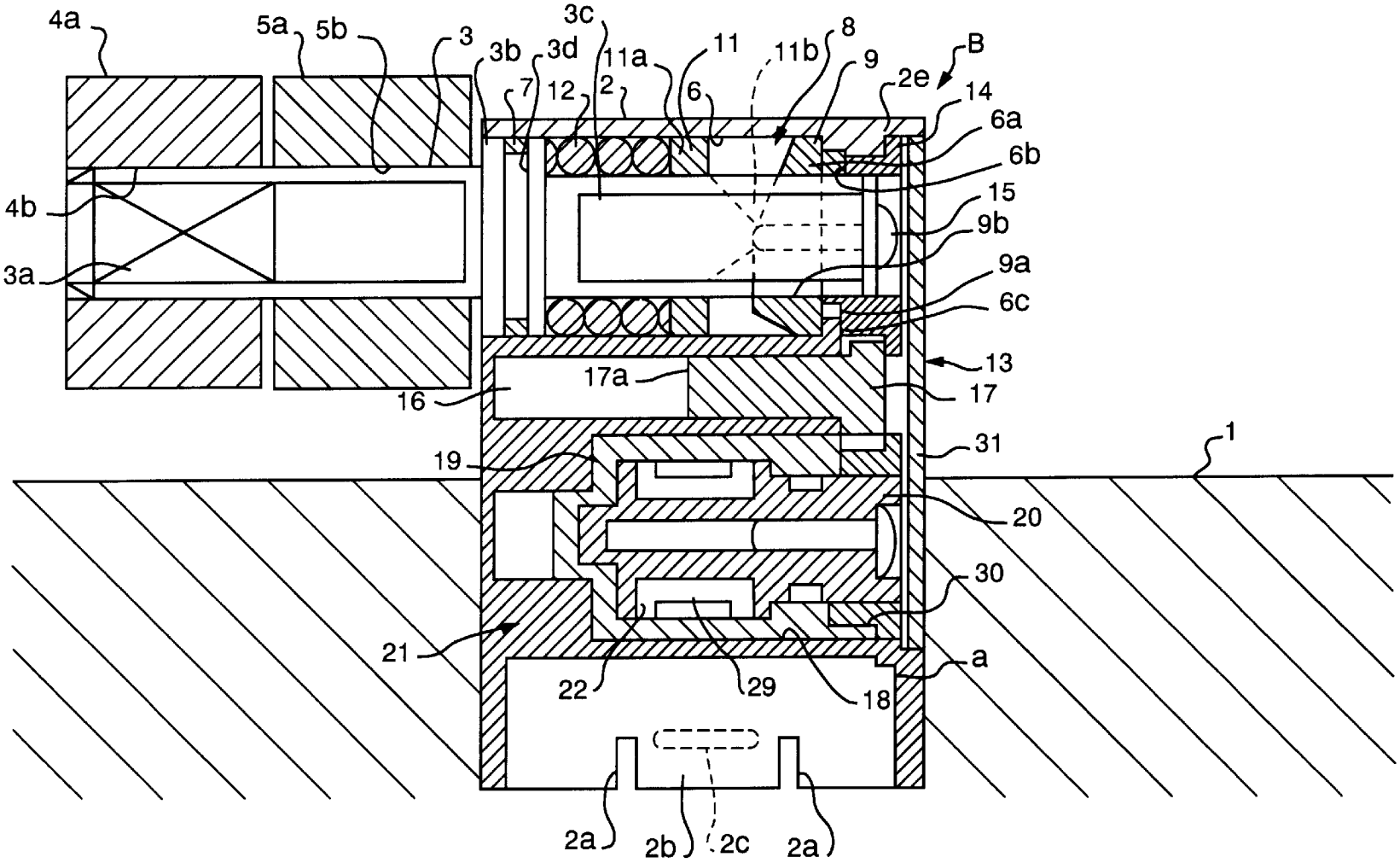
FIG. 3 is a longitudinal sectional view explaining the internal structure of the opening-closing device of the Western style toilet seat and seat cover shown in FIG. 1.
Figure 4:
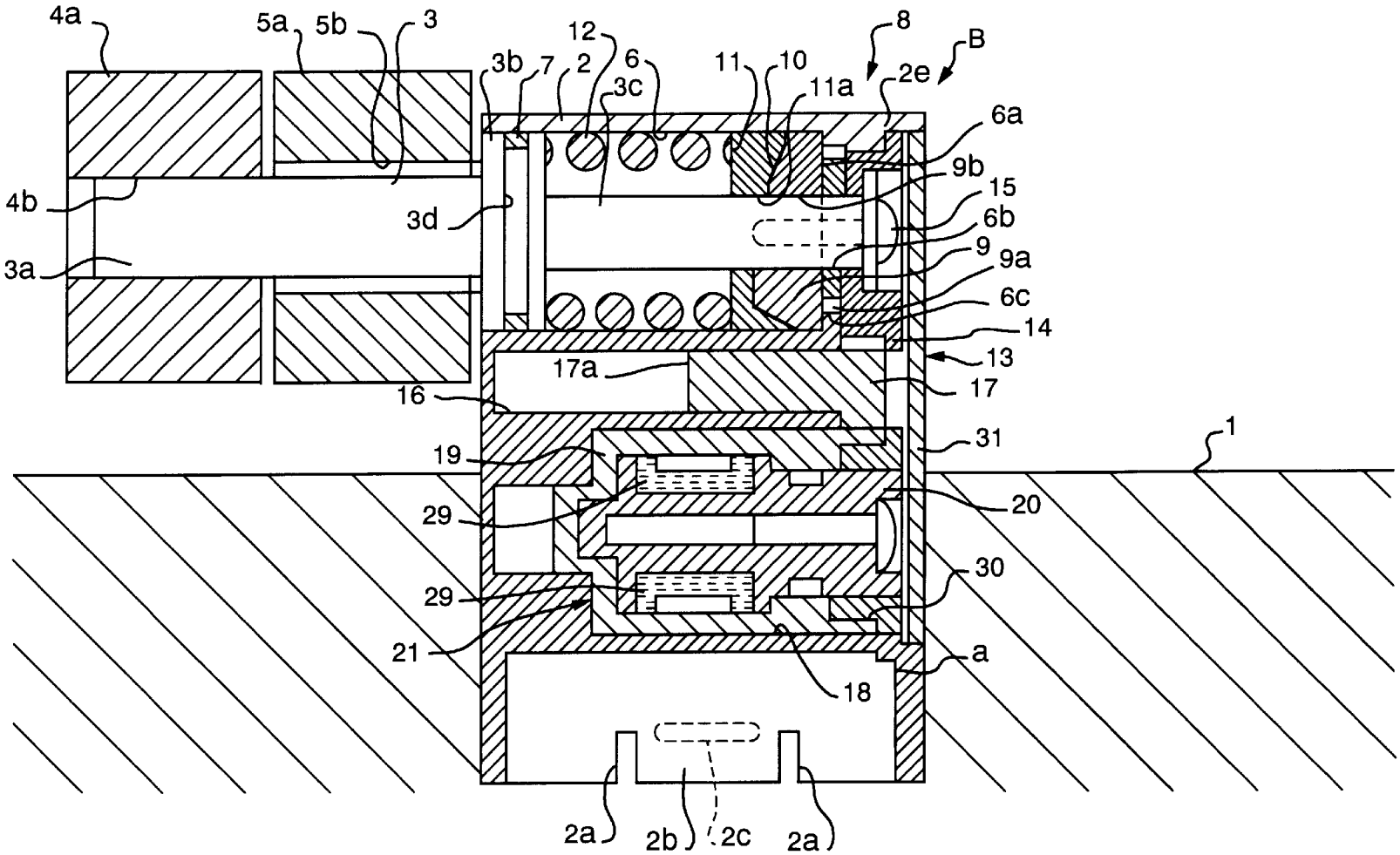
FIG. 4 is a longitudinal sectional view with the toil seat opening to 90 degrees from the state of FIG. 3.
Figure 5:
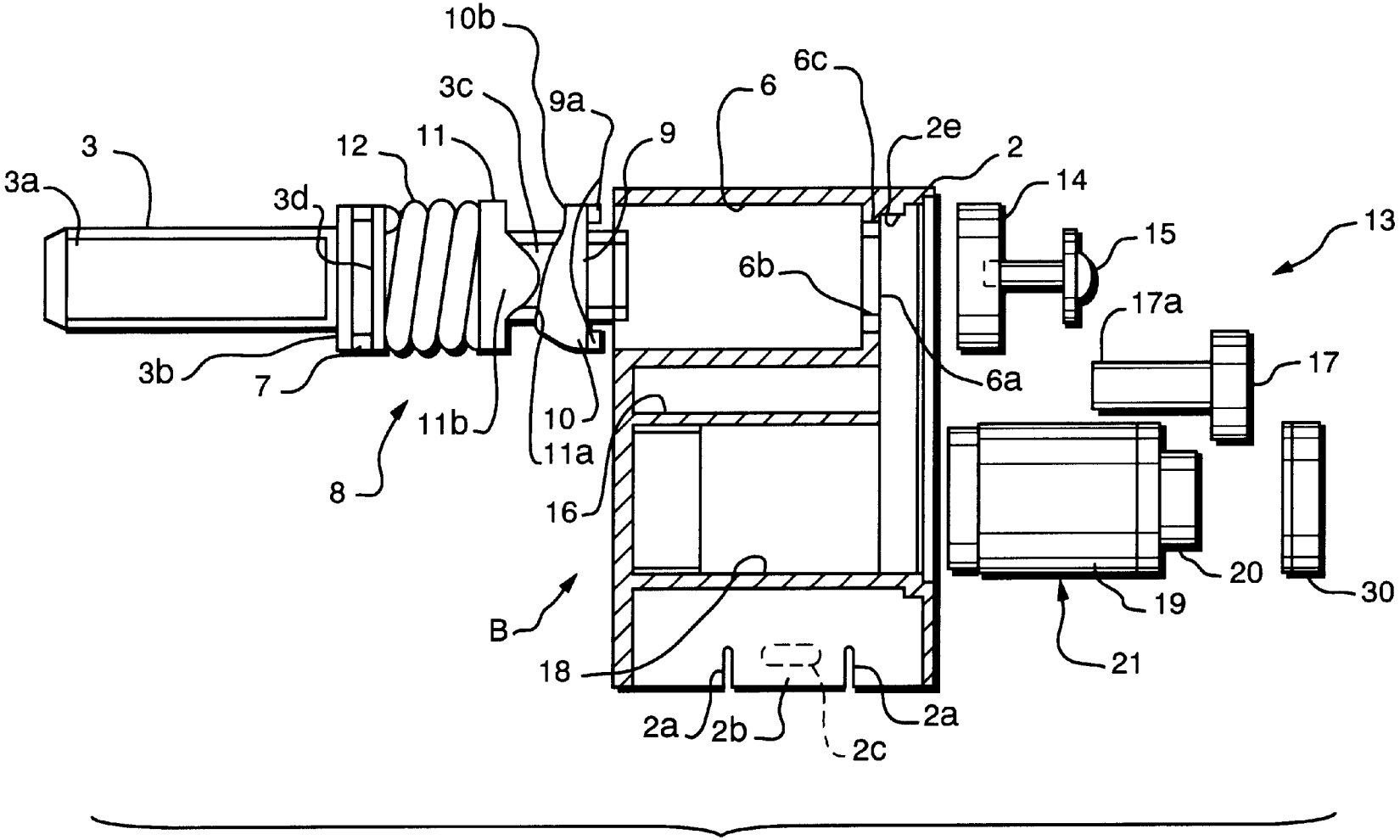
FIG. 5 is an exploded view of the opening-closing device of the Western style toilet seat and seat cover shown in FIG. 1.

Next, operation will be explained. As shown in FIGS. 2 and 3, when the toilet seat 4 is in a closed state, the convex portion 11*b* of the rotating-sliding cam 11 comprising the cam mechanism of the first rotation control means 8 shown in FIG. 3 faces in contact with the convex portion 10*a* of the cam portion 10 of the stationary cam 9, and the elastic means 12 is in the fully compressed state. Also, the valve plate 27 of the fluid damper constituting the second rotation control means 21 shown in FIG. 7 is in a position in which the long hole 25 is closed. When the toilet seat 4 is opened from this position, the first rotating shaft 3 with the mounting portion 5*a* engaged with the mounting shaft 3*a* rotates and the convex portion 11*b* of the rotating-sliding cam 11 rotating together in the same direction slides to the stationary cam 9 side while going down into the concave portion 10*b* from the convex portion 10*a* of the cam portion of the stationary cam 9.

In the meantime, the valve plate 27 of the fluid damper of the second rotation control means 21 is pushed by the viscous fluid 29 with the rotation of the second rotating shaft 20 which rotates together with the first rotating shaft 3 through the driving power transmitting means 13, rocking within the groove 24 to tilt from the long hole 25 side to the cutout 26 side. Thus, beside the clearance between the inner peripheral wall of the case body 19 and the blade section 23, there is formed a passage for the viscous fluid 29 which communicates with the opposite side of the blade section 23 through the recess 27*a* and the long hole 25 from the cutout 26.

Thus the first rotating shaft 3 and the second rotating shaft 20 are allowed to rotate smoothly to open the toilet seat 4 up to 110 degrees. This state is shown in FIG. 8. The blade section 23 of the second rotating shaft 20 contacts the stopper piece 28 of the case body 19 as depicted thereby preventing the toilet seat 4 from opening over 110 degrees.

Figure 13:
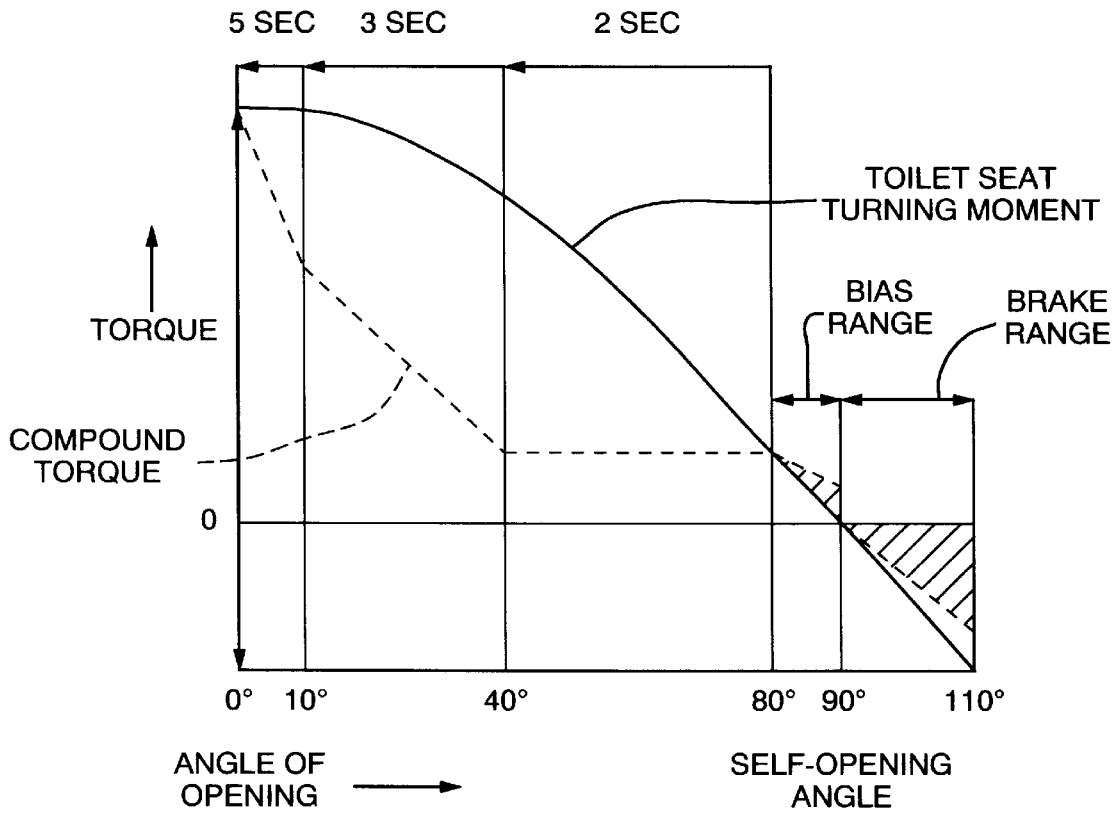
FIG. 13 is a chart showing the torque of the compound torque hinge according to the present invention.
Figure 14:
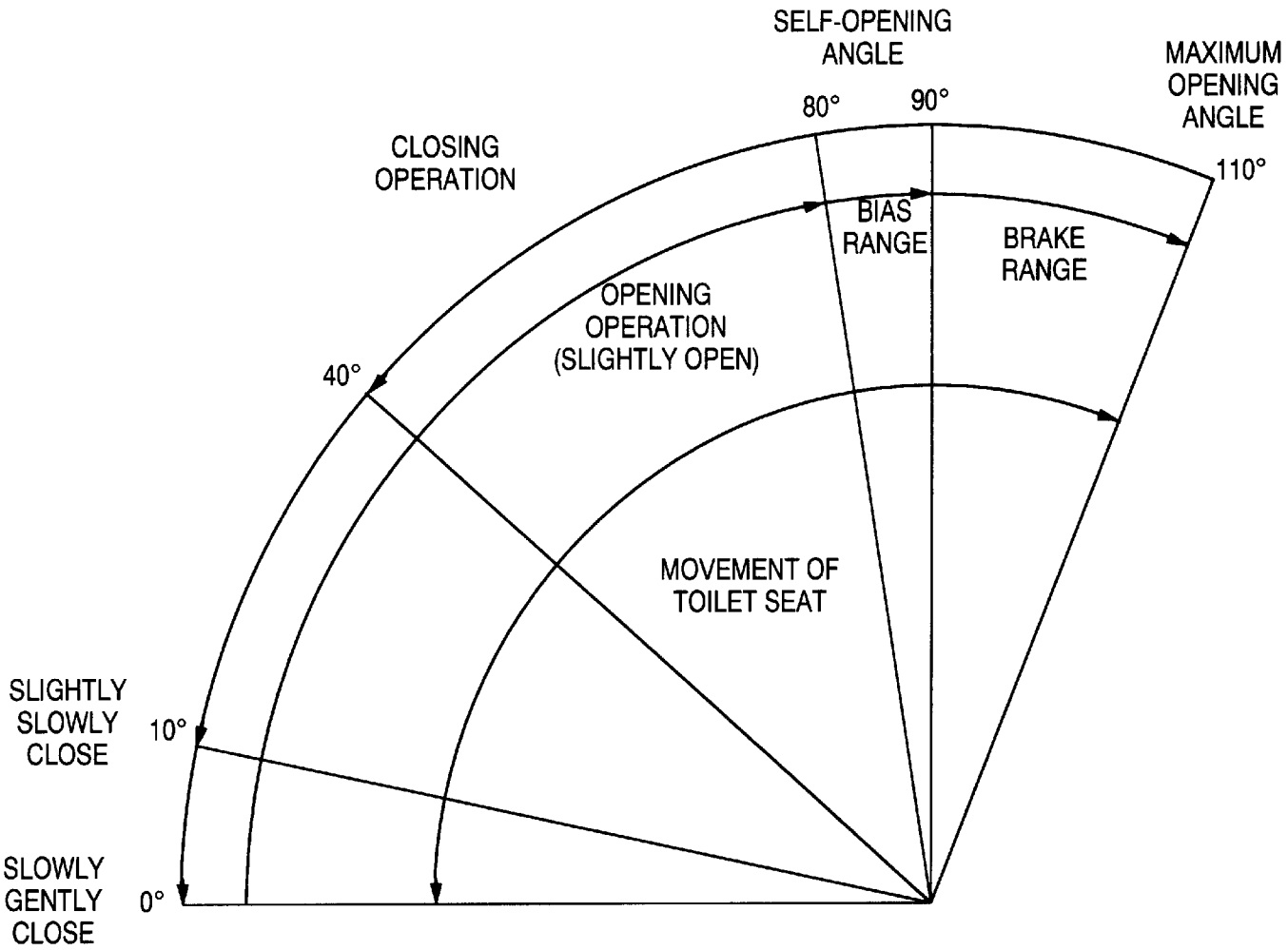
FIG. 14 is an explanatory view of operation of the compound torque hinge according to the present invention.

As shown in FIGS. 13 and 14, the toilet seat 4 can be opened automatically, by reducing a cam torque, further from 80 degrees up to 90 degrees at which the cam torque will reach zero. From this position, the toilet seat 4 is opened to the full-open angle of 110 degrees by increasing the cam torque again to apply the brake, thereby absorbing bound and rebound of the toilet seat 4. It is possible to provide seat opening operation with fine accent in accordance with the turning moment.

When the toilet seat 4 is to be closed from the opened position, the cam mechanism of the first rotation control means A performs to reverse the operation explained above. As shown in FIGS. 13 and 14, when the angle of opening of the toilet seat 4 is changed from about 40 degrees to change the position of contact of the convex portion 11*b* of the rotating-sliding cam 11 from the concave portion 10*b* to the convex portion 10*a* of the stationary cam 9 against the elasticity of the elastic means 12, a torque is produced in a reverse direction to cancel the turning moment of the toilet seat 4, to thereby prevent the abrupt closing of the toilet seat 4. In the meantime, in the fluid damper of the second control means B the viscous fluid 29 is forced, with the closing operation of toilet seat 4, to flow only through a clearance between the inner periphery of the case body 19 and the blade sections 23, 23 because the valves 22, 22 are rocked reversely in the grooves 24, 24 to close the long holes 25, 25, by the second rotating shaft 20 which rotates in the same direction as the first rotating shaft 3. Thus the damper is actuated to thereby prevent the sudden drop of the toilet seat 4 with the compound torque of the aforesaid cam mechanism and the fluid damper.

The toilet seat 4, when to be closed, therefore, can be smoothly closed without abruptly dropping by the virtue of the torque acting in the reverse direction of the cam mechanism of the first rotation control means and the damping operation of the fluid damper of the second rotation control means B.

In the present embodiment, as shown in FIGS. 13 and 14, when closed to 80 degrees, and then pushed a little downwards and released, the toilet seat 4 is closed to the closing angle of about 40 degrees at a relatively high speed, in about two seconds, by a low cam torque and damping operation. Thereafter, the convex portions 11*b*, 11*b* of the cam portion 10 of the rotating-sliding cam 11 of the cam mechanism contact the convex portions 10*a*, 10*a* of the stationary cam 9 and go upwards along the convex portions 10*a*, 10*a* against the elastic force of the elastic means 12; therefore the toilet seat 4 is slowly closed to the closing angle of about 10 degrees. Thereafter the seat is further closed slowly to 0 degree in about five seconds.

The operation time required for operating the toilet seat 4 is adjusted by the use of a compound torque which is a combination of the cam torque produced by the cam mechanism and the damping operation of the fluid damper, to thereby ensure smooth, effective movement of the toilet seat 4.

Only the opening-closing device B for the left toilet seat 4 has heretofore been described. The opening-closing device B for the right seat cover is also operated to operate the seat cover from the closed position However, since the seat cover is not so frequently operated as the toilet seat 4, it is not so much required to provide, unlike the toilet seat 4, the opening-closing operation with fine accent. It is, therefore, possible to use a stationary cam of much simpler shape. However, because the turning moment is basically the same as that in the case of the seat, only the shape of the stationary cam is different and the structure is the same in other respects and therefore will not be described.

It should be noticed that the opening-closing device B for the left toilet seat 4 has been explained, and that the opening-closing device B of the right seat cover 5 is also opened from the closed position shown in FIG. 2; since the seat over 5 is not so frequently operated as the toilet seat 4, it is not so much required to provide the opening and closing operation with fine accent as in the case of the toilet seat 4. Basically, the turning moment of the seat cover is the same as that of the seat; only the cam profile of the stationary cam differs. The opening-closing device B of the left seat cover 5 shown in FIG. 1 is the same in other points of structure, and therefore will not be explained.

What is claimed is:

1. A compound torque hinge, comprising: a first rotating shaft rotatably mounted in a case body so designed as to be mounted on a toilet bowl; a first rotation control means including a cam mechanism using an elastic means on one side housed in said case body of said first rotating shaft, second rotation control means including a rotation fluid damper which are juxtaposed in two stages within said case body located above or below said first rotation control means, and a driving power transmitting means mounted between said second rotation control means and said first rotation control means; and said rotating shaft supporting one of the mounting portions of said toilet seat and seat cover in a rotatable state, and securing the other to allow rotation together with said rotating shaft.

2. A compound torque hinge, comprising: a first rotating shaft rotatably mounted in a case body so designed as to be mounted on a toilet bowl; a first rotation control means including a cam mechanism using an elastic means on one side housed in said case body of said first rotating shaft, second rotation control means including a rotation fluid damper which are juxtaposed in two stages within said case body located above or below said first rotation control means, and a driving power transmitting means mounted between said second rotation control means and said first rotation control means; said rotating shaft supporting one of the mounting portions of said toilet seat and seat cover in a rotatable state, and securing the other to allow rotation together with said rotating shaft; and furthermore said cam mechanism being comprised of a stationary cam fixedly mounted on a partition wall provided in said hinge case with said rotating shaft inserted in the center, a rotating-sliding cam located oppositely to said stationary cam, engaged with said first rotating shaft, and slidable in the axial direction of said first rotating shaft, and said elastic means for pushing said rotating-sliding cam towards said stationary cam side.

3. A compound torque hinge, comprising: a first rotating shaft rotatably mounted in a case body so designed as to be mounted on a toilet bowl; a first rotation control means including a cam mechanism using an elastic means on one side housed in said case body of said first rotating shaft, second rotation control means including a rotation fluid damper which are juxtaposed in two stages within said case body located above or below said first rotation control means, and a driving power transmitting means mounted between said second rotation control means and said first rotation control means; said rotating shaft supporting one of the mounting portions of said toilet seat and seat cover in a rotatable state, and securing the other to allow rotation together with said rotating shaft; and said rotation damper being comprised of a case body secured in said hinge case, a second rotating shaft mounted in said case body and projecting out of said case body, a valve mounted on said second rotating shaft, a viscous fluid filled in said case body, and a stopper piece protruding from the inner peripheral wall of said case body for checking rotation of said valve.

4. A compound torque hinge, comprising: a first rotating shaft rotatably mounted in a case body so designed as to be mounted on a toilet bowl; a first rotation control means including a cam mechanism using an elastic means on one side housed in said case body of said first rotating shaft, second rotation control means including a rotation fluid damper which are juxtaposed in two stages within said case body located above or below said first rotation control means, and a driving power transmitting means mounted between said second rotation control means and said first rotation control means; said rotating shaft supporting one of the mounting portions of said toilet seat and seat cover in a rotatable state, and securing the other to allow rotation together with said rotating shaft; said rotation damper being comprised of a case body secured in said hinge case, a second rotating shaft mounted in said case body and projecting out of said case body, a valve mounted on said second rotating shaft, a viscous fluid filled in said case body, and a stopper piece protruding from the inner peripheral wall of said case body for checking rotation of said valve; and furthermore said valve being comprised of a blade section projecting from said second rotating shaft and housed in said case body, a groove formed axially from the edge of said blade section, a long hole formed from one side of said groove towards one side in the direction of rotation of said blade section, a cutout formed from another side of said groove towards another side in the direction of rotation of said blade section, and a valve means rotatably housed in said groove for opening and closing said long hole.

5. A compound torque hinge, comprising: a first rotating shaft rotatably mounted in a case body so designed as to be mounted on a toilet bowl; a first rotation control means including a cam mechanism using an elastic means on one side housed in said case body of said first rotating shaft, second rotation control means including a rotation fluid damper which are juxtaposed in two stages within said case body located above or below said first rotation control means, and a driving power transmitting means mounted between said second rotation control means and said first rotation control means; said rotating shaft supporting one of the mounting portions of said toilet seat and seat cover in a rotatable state, and securing the other to allow rotation together with said rotating shaft; said cam mechanism being comprised of a stationary cam fixedly mounted on a partition wall provided in said hinge case with said rotating shaft inserted in the center, a rotating-sliding cam located oppositely to said stationary cam, engaged with said first rotating shaft, and slidable in the axial direction of said first rotating shaft, and said elastic means for pushing said rotating-sliding cam towards said stationary cam side; and said rotation damper being comprised of a case body secured in said hinge case, a second rotating shaft mounted in said case body and projecting out of said case body, a valve mounted on said second rotating shaft, a viscous fluid filled in said case body, and a stopper piece protruding from the inner peripheral wall of said case body for checking rotation of said valve.

6. A compound torque hinge, comprising: a first rotating shaft rotatably mounted in a case body so designed as to be mounted on a toilet bowl; a first rotation control means including a cam mechanism using an elastic means on one side housed in said case body of said first rotating shaft, second rotation control means including a rotation fluid damper which are juxtaposed in two stages within said case body located above or below said first rotation control means, and a driving power transmitting means mounted between said second rotation control means and said first rotation control means; said rotating shaft supporting one of the mounting portions of said toilet seat and seat cover in a rotatable state, and securing the other to allow rotation together with said rotating shaft; said cam mechanism being comprised of a stationary cam fixedly mounted on a partition wall provided in said hinge case with said rotating shaft inserted in the center, a rotating-sliding cam located oppositely to said stationary cam, engaged with said first rotating shaft, and slidable in the axial direction of said first rotating shaft, and said elastic means for pushing said rotating-sliding cam towards said stationary cam side; said rotation damper being comprised of a case body secured in said hinge case, a second rotating shaft mounted in said case body and projecting out of said case body, a valve mounted on said second rotating shaft, a viscous fluid filled in said case body, and a stopper piece protruding from the inner peripheral wall of said case body for checking rotation of said valve; and furthermore said valve being comprised of a blade section projecting from said second rotating shaft and housed in said case body, a groove formed axially from the edge of said blade section, a long hole formed from one side of said groove towards one side in the direction of rotation of said blade section, a cutout formed from another side of said groove towards another side in the direction of rotation of said blade section, and a valve means rotatably housed in said groove for opening and closing said long hole.

7. A compound torque hinge as claimed in any one of claims 1 to 6, wherein said driving power transmitting means is a gear.

* * * * *